United States Patent [19]

Lala

[11] 4,282,806

[45] Aug. 11, 1981

[54] SILK SCREEN PRINTING MACHINE

[75] Inventor: Louis A. Lala, Chicago, Ill.

[73] Assignee: American Screen Printing Equipment Company, Chicago, Ill.

[21] Appl. No.: 927,553

[22] Filed: Jul. 24, 1978

[51] Int. Cl.[3] ..... B41F 15/08; B41F 15/30; B41F 15/42

[52] U.S. Cl. ..... 101/38 R; 101/41; 101/123; 101/124

[58] Field of Search ..... 101/123–124, 101/38 R, 38 A, 35, 41, 119, 120

[56] References Cited

U.S. PATENT DOCUMENTS

| | | | |
|---|---|---|---|
| 3,090,300 | 5/1963 | Dubuit | 101/123 |
| 3,545,377 | 12/1970 | Harwell | 101/123 |
| 3,659,523 | 5/1972 | Olsen | 101/123 |
| 4,068,579 | 1/1978 | Poo et al. | 101/124 X |
| 4,079,671 | 3/1978 | Dubuit | 101/124 |
| 4,184,427 | 1/1980 | Bubley et al. | 101/123 |

FOREIGN PATENT DOCUMENTS

| | | | |
|---|---|---|---|
| 2739987 | 3/1978 | Fed. Rep. of Germany | 101/123 |

*Primary Examiner*—J. Reed Fisher
*Attorney, Agent, or Firm*—Robert E. Wagner

[57] ABSTRACT

A screen printing apparatus having a screen support carriage and squeegee support mechanism which are both mounted for separate lateral back and forth movement on horizontal support bars which are in turn mounted for vertical movement. The vertical movement of the support bars and the lateral movement of either the squeegee support mechanism or the carriage support mechanism is produced by penumatic cylinders which are sequentially operated through a pneumatic control system.

6 Claims, 6 Drawing Figures

SILK SCREEN PRINTING MACHINE

BACKGROUND OF THE INVENTION

1. Field of the Invention

The present invention relates to printing machines, and more particular, to silk screen printing machines capable of printing on a variety of geometric configurations.

2. Prior Art

Silk screening is of course an ancient art, but it has been modernized to significant extents as a result of automation or semi-automation of the equipment utilized to produce the silk screening designs. One of the major commercial applications today is in the printing of bottles and plastic containers of various geometric configurations and surfaces of revolution such as for example, cylindrical, oval and rectangular.

In some operations of printing such geometrically configured containers and the like, it is necessary to hold the silk screen stationary while moving the squeegee across the surface of the silk screen in order to pass the printing liquid through the screen and create the design. In still other applications it is necessary to reciprocate laterally the silk screen while maintaining the squeegee stationary in engagement with the surface of the screen in order to pass the printing liquid through the screen.

Since silk screen printing machinery is often utilized for a variety of applications it must generally be adaptable to either mode of operation. It is further worthy to note that there are other variations in the type of relative movement between the squeegee and the silk screen such as a rotary motion of the squeegee to cause the printing liquid to be passed through the screen as the squeegee moves in a circular pattern. Such a novel additional apparatus is disclosed for example in applicant's copending application and which is adapted to be attached to the machine of the present invention.

The present invention, however, is more closely related to those silk screen printing apparatus when used in such a manner that either the squeegee or the silk screen is reciprocated laterally. In such type of silk screening operations it is necessary that once the design has been transferred to the surface of the container, provision be made for separating the silk screen from the surface of the container so that the object can be removed and a subsequent object inserted for engagement with the silk screen to continue the operation on that object.

In this regard, it is important that both the squeegee and the screen be separated as closely perpendicular as possible from the object in order that the design which has been printed on the object is not smeared when the surface of the silk screen is removed from the object. In one well known prior art device, this is accomplished by a parallelogram linkage which is designed to rotate the silk screen carrier and the squeegee away from the object being printed on with the parallelogram linkage further causing relative movement between the squeegee and the silk screen.

SUMMARY OF THE INVENTION

The present invention overcomes the deficiencies the prior art by providing a mechanism which lifts the silk screen exactly perpendicular from the surface of the object being printed, and in addition, causes simultaneous separation of the squeegee from the upper surface of the silk screen.

This is accomplished by providing a silk screen printing machine which comprises a machine frame carrying a screen carrier support means having at least one horizontally extending support member mounted at each end to the machine frame for relative vertical movement thereon; a silk screen carrier laterally movably mounted to the silk screen support means for vertical movement therewith; a first reciprocable drive means for causing vertical movement of the silk screen carrier support means on command; a squeegee carrier; a squeegee carrier support means supported by the silk screen carrier support means for vertical movement therewith and for independent lateral movement thereon and connected thereto with a parallelogram linkage means for causing relative movement between the squeegee carrier and the screen carrier upon vertical movement of the screen carrier support means; and a second reciprocable drive means engageable with either the screen carrier or the squeegee carrier support means for selectively causing lateral movement of either.

In its preferred form, the apparatus of the present invention is designed to carry the silk screen carrier on a pair of horizontally extending cylindrical rods so that the silk screen carrier is laterally movable on these rods. The rods in turn are supported at their ends by vertically extending bars which are supported in the machine frame for vertical movement so as to move the horizontally extending cylindrical rods up and down and thus move the screen carrier vertically with respect to the horizontally positioned surface of an object being printed.

The squeegee carrier is in turn supported by a vertically extending member which is disposed in spaced parallel relation in front of the cylindrical rods. The squeegee carrier is in turn supported by a vertically extending member which is disposed in spaced parallel relation in front of the cylindrical rods. A pair of upper and lower tie rods are pivotally mounted to the respective upper and lower cylindrical rods and have one end portion of each pivotally mounted to respectively upper and lower end portions of the vertically extending support member with the other end portion of one of the tie rods extending beyond the cylindrical rod and being further pivotally connected to the machine frame, or in this case, actually to a stationary rod supported on the machine frame. The pivotal connections to both the cylindrical rods and the machine frame permit lateral movements of the tie rods along the cylindrical rods independently of the screen carrier in order to permit the squeegee carrier to be moved independently of the screen carrier.

This mechanism produces relative movement between the squeegee and the surface of the screen as the cylindrical rods supporting the screen carrier are moved vertically. Thus, the mechanism accomplishes the most desirable movement of having the silk screen removed perpendicularly from the horizontal surface of the object being printed and simultaneously causes separation of the squeegee from the upper surface of the silk screen through the parallelogram linkage described.

Upward movement of the vertically extending end bars which support the horizontal cylindrical rods which in turn support the screen carrier and the squeegee carrier, is preferably accomplished by double acting pneumatic cylinders which are controlled in timed relation to the lateral movement of either the squeegee carrier or the screen carrier depending upon which is being moved laterally and which is being held stationary. In turn, lateral movement of either the screen carrier or the squeegee carrier is preferably accomplished by a pneumatic double acting cylinder which is provided with limit stops that permit adjustment of the extent of lateral movement of either the squeegee carrier or the screen carrier. At the end of each limit of the lateral movement a corresponding movement of the vertically extending end bars is accomplished to either place the screen and the squeegee in position over the object to be printed or remove the silk screen and squeegee from the object after printing.

DETAILED DESCRIPTION OF THE PREFERRED EMBODIMENT

Figure 2:
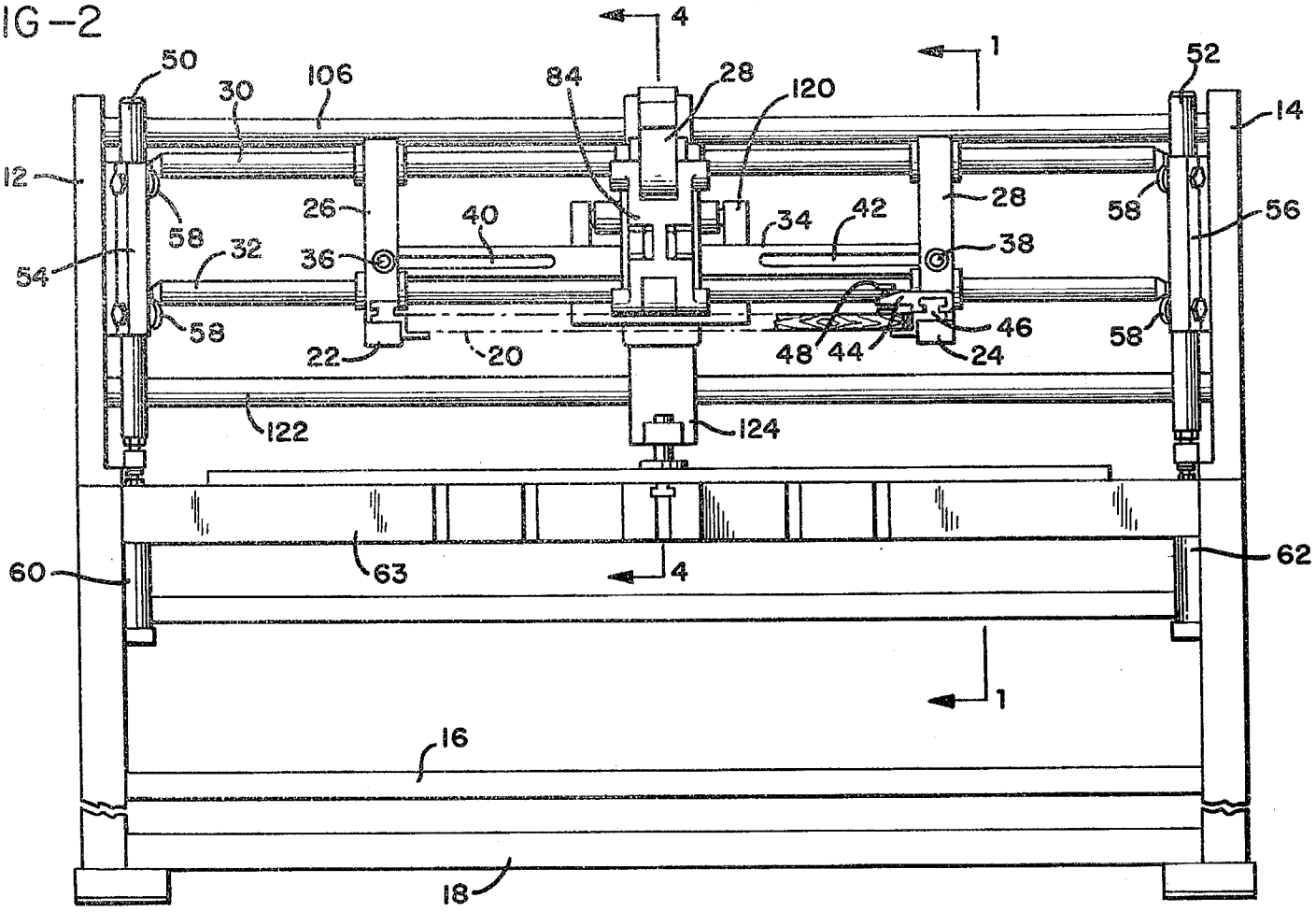
FIG. 2 is a front elevational view with the squeegee support bar, squeegee height adjustment mechanism, squeegee and object support mechanism removed.

Referring first to FIG. 2, the main machine frame consists generally of vertical side structures 12 and 14 which are held rigid by a plurality of horizontal braces such as 16 and 18.

A silk screen 20 is supported by a silk screen carrier which is generally composed of a pair of horizontally extending support bars 22 and 24 which extend in cantilever fashion outwardly in parallel spaced relation from a pair of vertically extending carrier support members 26 and 28. Carrier support members 26 and 28 are in turn slidingly supported at their upper and lower ends on upper and lower cylindrical rods 30 and 32 which are disposed in spaced parallel horizontal position with the carrier support members 26 and 28 being slidable laterally in either direction thereon, as shown in FIG. 2.

A connector bar 34 is bolted at each end to the carrier support members 26 and 28 by bolts 36 and 38 which pass through the respective carrier support members and through elongated slots 40 and 42 formed in the connecting bar 34 so that the support bars 22 and 24 may be separated a desired distance to accept a variety of widths of silk screens 20. The bolts 36 and 38 are tightened when the proper width for a given screen 20 is established and will then maintain the spacing between the carrier support members 26 and 28 when they are either stationary or moved laterally along the cylindrical support rods 30 and 32.

The silk screen 20 is held in engagement with the horizontally extending support bars 22 and 24 by clamping members such as 44 (only one clamping member being shown, but the clamping member associated with the support bar 22 will be identical) which is supported on a channel member 46 secured to the support bar 24. The clamping member 44 is held in position by thumb screw 48 which is tightened into engagement with the frame portion of the screen 20 to hold the screen in position in the carrier.

Figure 3:
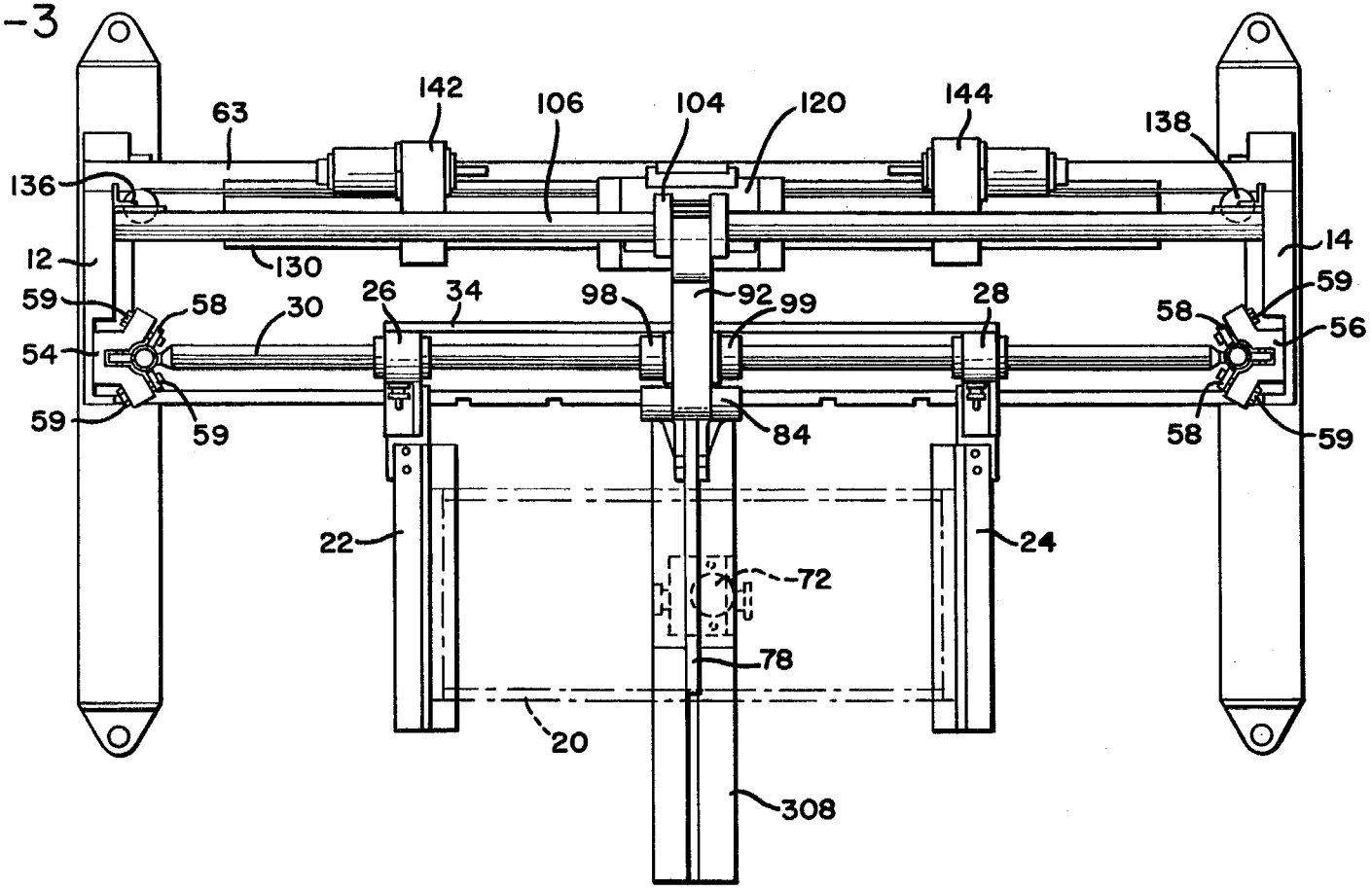
FIG. 3 is a top plan view of the preferred embodiment of the present invention with portions removed as in FIG. 2 and with the squeegee height adjustment mechanism shown in phantom.

Cylindrical support rods 30 and 32 are secured at each of their ends by a pair of spaced vertically extending end bars 50 and 52. End bars 50 and 52 are supported on the main machine frame so as to be movable vertically up and down, but are otherwise captive. To hold the end rods 50 and 52 for movement, a pair of channel members 54 and 56 are utilized which are secured to the main vertical side structures 12 and 14 respectively as best seen in FIGS. 2 and 3. The vertically extending end rods 50 and 52 are cylindrical and are supported in channel members 54 and 56 by a plurality of rollers 58 disposed at equal radial distances about each of the vertically extending end rods 50 and 52 so as to support them for vertical movement. Bolts 59 are used to support the outer pair of rollers 58 in an adjustable manner so that end rods 50 and 52 can be removable from the channel members 54 and 56 and can be held in engagement with each of the rollers 58 by adjustment of the screws 59.

The vertically extending end rods 50 and 52 are connected at their lower ends respectively to double acting pneumatic cylinders 60 and 62 secured to a horizontal base plate 63 mounted between vertical side structures 12 and 14 of the machine frame. Pneumatic cylinders 60 and 62 thus move end rods 50 and 52 upwards or downwards, simultaneously on command as described in more detail below in connection with the schematic diagram of the pneumatic operating system of FIG. 6.

Referring now to the squeegee carrier mechanism, the squeegee 70 is supported by a vertical adjustment mechanism 72 which permits accurate vertical adjustment of the squeegee 70 relative to the surface of the silk screen 20. The squeegee 70 is carried on the lower portion of the adjustment mechanism 72 through a threaded member positioned internally thereof and secured at its upper end to the circular knob 74 which is used to rotate the threaded member in order to cause vertical movement of the squeegee 70. A cylindrical calibrated dial 76 is provided in order to permit more exact adjustment of the position of the squeegee 70 relative to the silk screen surface 20.

The vertical adjustment mechanism 72 is supported for sliding movement on a horizontally extending bar 78 so that the squeegee 70 can be positioned properly in the fore and aft direction relative to the screen 20. The vertical adjustment mechanism 72 can then be held in position on bar 78 by the friction screw 80 which can be tightened against the side of the bar 78.

The bar 78 is in turn pivotally secured at its inboard end by pin 82 to a vertically extending support member 84. A slotted opening 86 is provided in the extended portion 88 of the vertical support member 84 and is slanted to permit pivotal movement of the bar 78 and thus the vertical support mechanism 72 and squeegee 70 so that the squeegee 70 can be manually rotated away from the silk screen surface during assembly or servicing of the equipment. The bottom of the slot 86 acts as a position stop for the pin 90 secured to the bar 78 so that the bar 78 will be disposed in a horizontal position when the pin 90 is at the bottom of the slot 86.

The vertically extending support member 84 is in turn pivotally connected at its upper and lower end portions respectively to upper and lower tie rods 92 and 94 by pins 96 and 97 which extend through the vertically extending member 84 and tie rods 92 and 94. The other end of the tie rods 92 and 94 are in turn pivotally mounted to upper and lower horizontally extending support bars 30 and 32 and are free to move laterally along the support bars 30 and 32, independently of the movement of the carrier support members 26 and 28.

To provide additional stabilizing support to tie rods 92 and 94 so as to prevent their binding on support bars 30 and 32 when being moved laterally, a pair of auxiliary support plates 98 and 99 are placed in engagement with and on opposite sides of tie rods 92 and 94 and have their upper and lower end portions provided with holes through which support bars 30 and 32 pass. The auxiliary support plates 98 and 99 are secured together and thus provide additional lateral stability to tie rods 92 and 94.

The upper tie rod 92 has a further extended end portion 100 which extends rearward beyond the upper support bar 30 and has a U-shaped opening 102 which engages a corresponding collar 104 that maintains the end portion 100 captive for lateral movement along a guide bar 106 which in turn is secured at each end to the vertical side structures 12 and 14.

Figure 1:
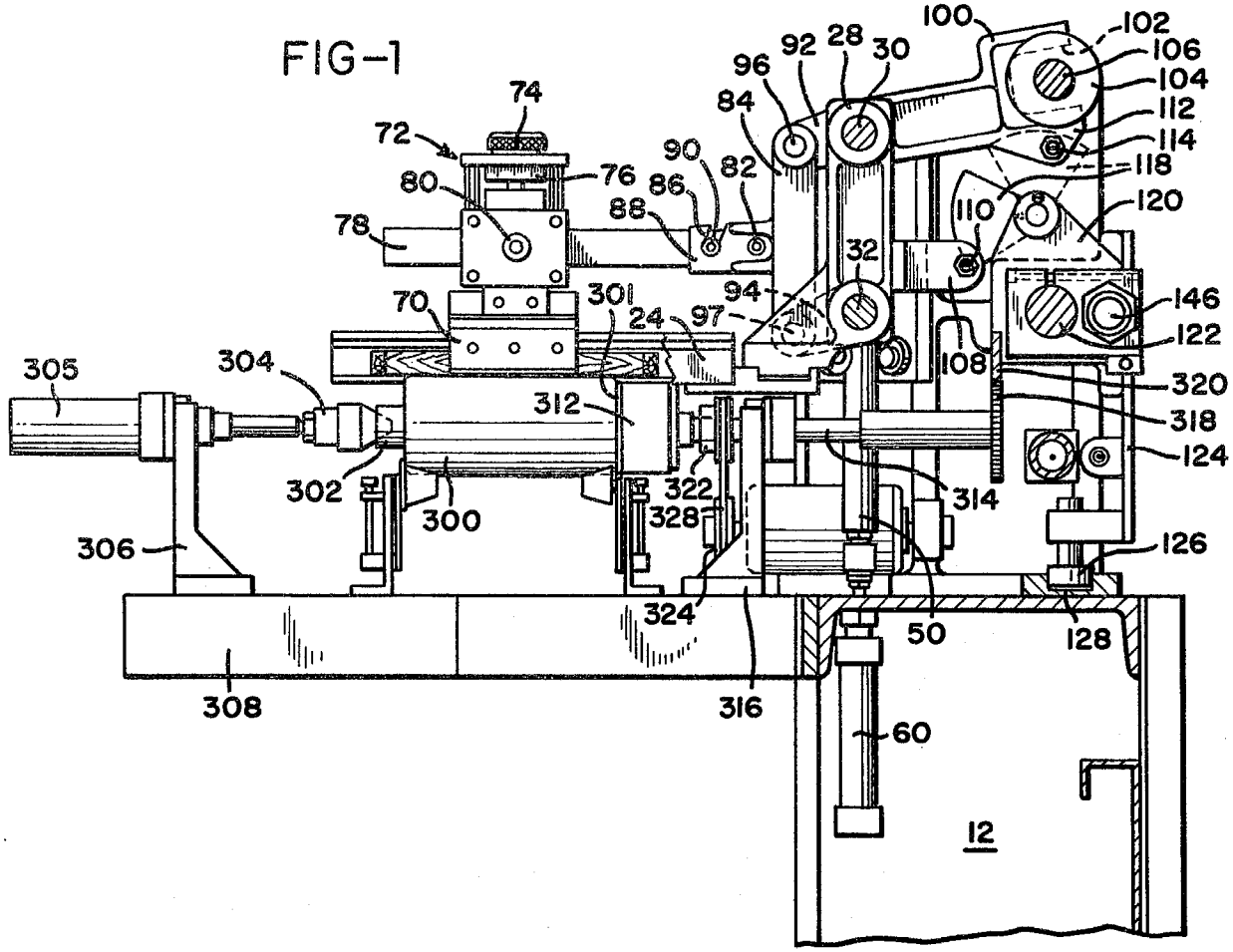
FIG. 1 is a cross sectional side view along the line 1—1 of FIG. 2, illustrating a preferred embodiment of the present invention.
Figure 4:
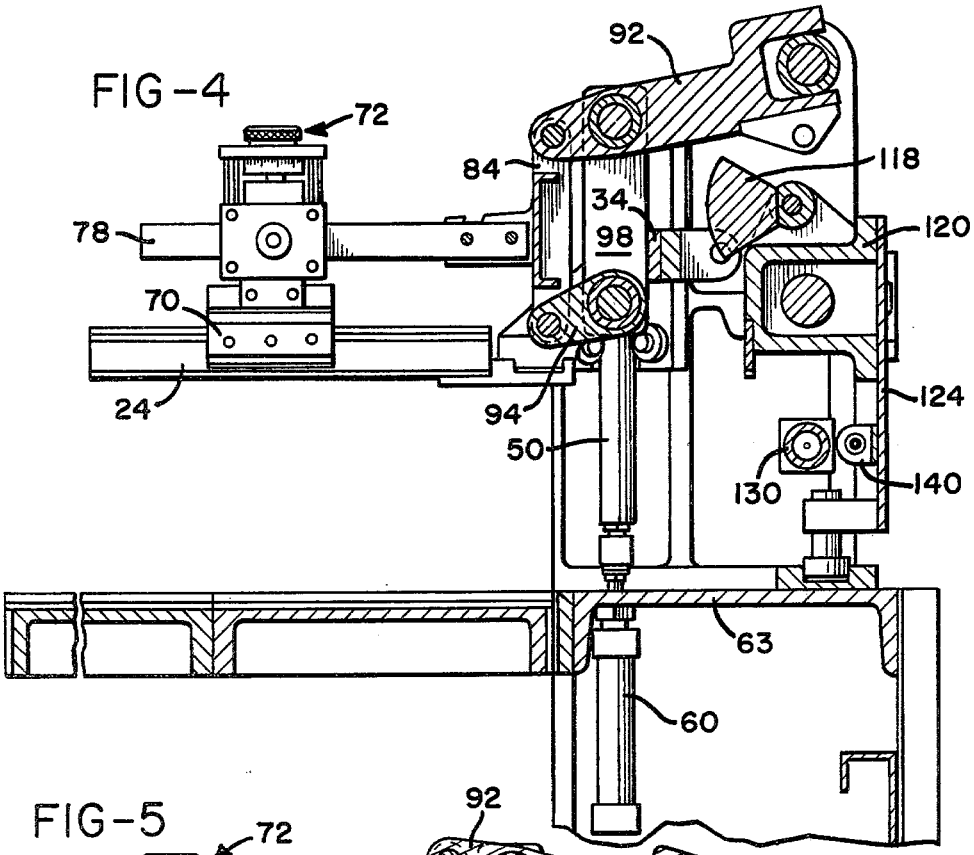
FIGS. 4 and 5 are cross sectional views along the line 4—4 of FIG. 2 which illustrate the squeegee, the screen and screen carrier in different positions.
Figure 5:
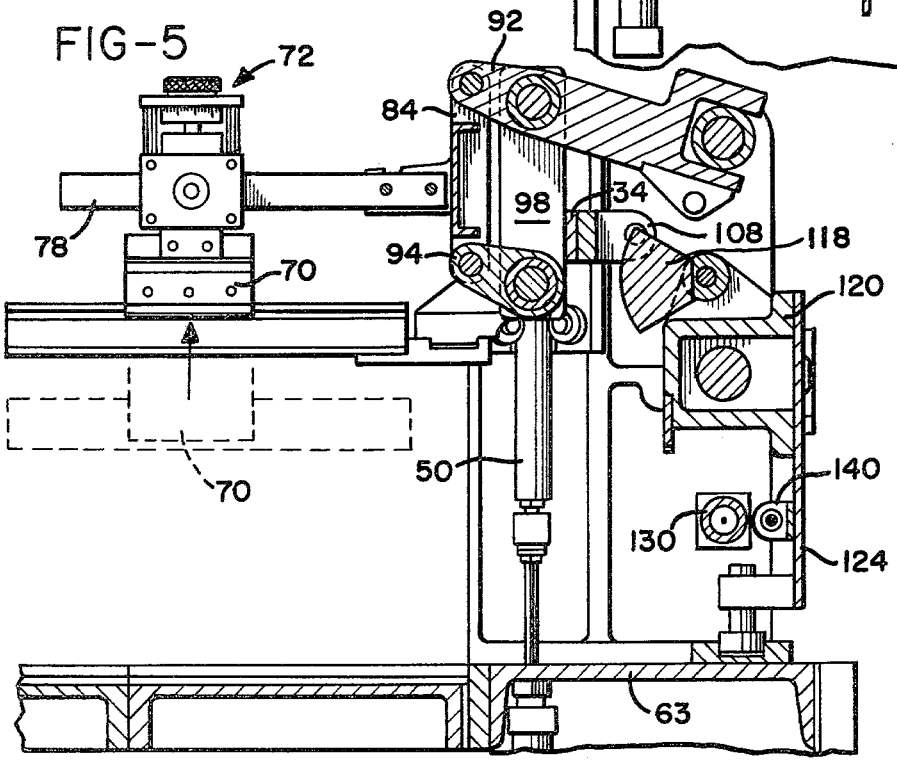

Thus, when the vertically extending end rods 50 and 52 are moved upwardly from the position shown in FIGS. 1 and 4 to the position shown in FIG. 5, the captive extended end portion of upper tie rod 92 will cause the tie rods 92 and 94 to be pivoted about the upper and lower support bars 30 and 32, respectively, thus moving the vertical support member 84 rotationally upwardly due to the parallelogram linkage established by rigidly secured rods 30 and 32, vertically extending support member 84 and upper and lower tie rods 92 and 94. This of course, in turn will cause upward rotational movement of squeegee 70 relative to the silk screen 20, as shown in the sequence of FIGS. 4 and 5. Likewise, when the vertically extending end rods 50 and 52 are lowered, the squeegee, through the same mechanism of parallelogram linkage, will be lowered into proper position relative to the silk screen 20 for printing on the object.

Referring now to the manner in which both the silk screen carrier and the squeegee carrier are moved laterally on the horizontally extending support bars 22 and 24, it is, of course, only necessary to move one or the other of the mechanisms laterally depending on the type of the object being printed and therefore the following described mechanism is easily selectably positionable so as to move only either the silk screen 20 or the squeegee 70 back and forth on horizontal support bars 22 and 24.

First, with regard to the silk screen carrier lateral movement, the connecting bar 34 is further provided upon its back side with a U-shaped bracket 108, as best illustrated in FIGS. 1, 4 and 5, which is provided with a pair of pins 110, one extending through either tab portion of the U-shaped bracket 108 and threaded on the end extending through the bracket so that the inwardly protruding portion can be adjusted in order that the space between the inner adjacent ends of the pins 110 can be increased or decreased.

The extended portion 100 of upper tie rod 92 associated with the squeegee carrier mechanism likewise has a U-shaped bracket 112 depending downwardly therefrom, also as best illustrated in FIGS. 1, 4 and 5. This bracket further has a pair of pins 114 in the outer tab portions of the U-shaped bracket 112 which, like those in the U-shaped bracket 108, extend inwardly and are secured with a threaded portion and a bolt so that the spacing between the inward adjacent end portions of the pins 114 can be adjusted.

A fan-shaped section 118 is pivotally mounted to a drive member 120. The fan-shaped section 118 is so positioned relative to the U-shaped brackets 108 and 112 that it can pass between the extended tab portions of either thereof so as to only engage one of the brackets at a time. The pins 110 and 114 respectively associated with the brackets 108 and 112 can be adjusted to be in fairly close proximity to the corresponding side portions of the fan shaped section so that there is little play in the reversing of the lateral movement between the drive member 120 and the U-shaped bracket engaged by the fan shaped section 118 and can in fact be brought into tight engagement therewith to hold the fan-shaped section in place.

The drive member 120 is fitted on a further cylindrical rod 122 supported at each end in the vertical side structures 12 and 14 of the machine frame. In addition, a stabilizing support bracket 124 depends downwardly from the back surface of drive member 120 and has secured to the lower end portion thereof a roller 126 which rides in a keyway 128 defined in the frame structure so as to prevent binding of the drive member 120 as it slides along the further cylindrical rod 122.

A further double acting pneumatic cylinder 130 is supported between the vertical side structures 12 and 14 in parallel aligned relation to the further cylindrical rod 122 and adjacent the stabilizing support bracket 124. As shown schematically in FIG. 6, a belt 132 is secured at its ends to a piston 134 in the cylinder 130 and is trained about pulleys 136 and 138 mounted at each end of the cylinder 130 on the respective vertical side structures 12 and 14. On the run of the belt opposite the side connected to the piston 134, the drive means 120 is secured thereto by attachment to the bracket 140, which bracket is also shown in FIGS. 4 and 5.

Figure 6:
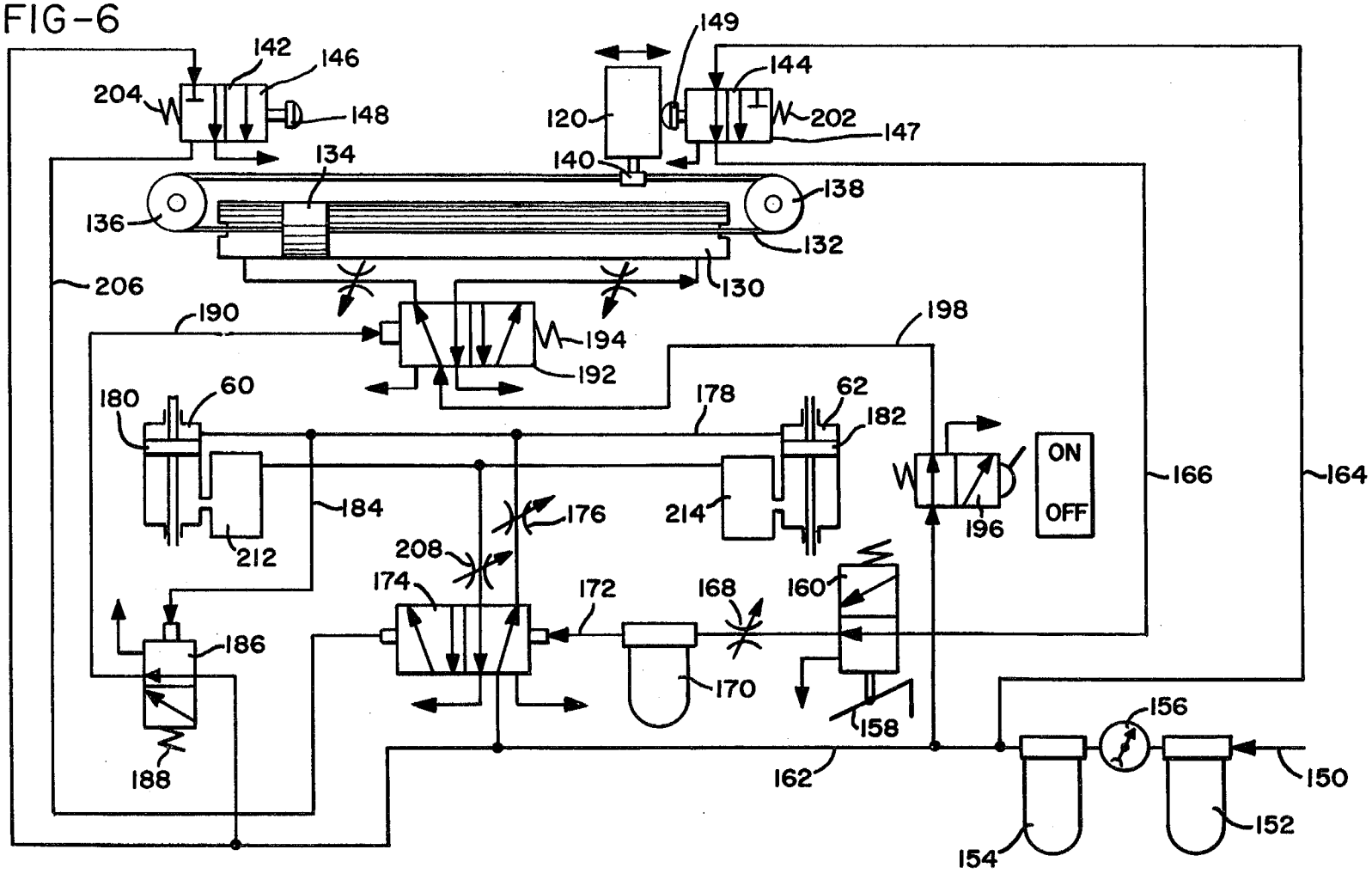
FIG. 6 is a schematic diagram of the pneumatic control mechanism which operates the preferred embodiment of the present invention.

Thus, it can be seen that movement of the piston 134 in either direction will result in corresponding movement of drive member 120 in the opposite direction. A pair of limit stop assemblies 142 and 144, as shown in FIG. 3 and schematically illustrated in FIG. 6, are adjustably secured to further cylindrical rod 122 as shown in FIG. 1. This is preferably accomplished by using the split block as shown in FIG. 1 with a screw extending through the split so that it may be tightened down onto the rod 122 at the desired location. Each limit stop assembly 142 and 144 is provided with a two position pneumatic valve 146 and 147, respectively, each of which is respectively provided with a plunger 148 and 149 as schematically illustrated in FIG. 6, which is positioned to engage the drive member 120 as it approaches the respective limit stop 142 or 144.

Referring now to the pneumatic control circuitry of the silk screen mechanism of the present invention, none of the pneumatic lines are illustrated in FIGS. 1 through 5 in order to reduce the complexity of the drawings to thus enhance the clarity thereof. However, each of the double acting pneumatic cylinders 60, 62 and 130 are each associated with a pneumatic control circuitry which involves a plurality of valves and control mechanisms all of which are described below and which effect appropriate sequential operation of the silk screening device of the present invention.

An air supply source (not shown) supplies air through air line 150 to a pair of accumulators 152 and 154 with an intermediate pressure gage 156 to thus maintain a uniform level of pressure to the remaining circuitry. In the intitial start position, the foot pedal 158 is depressed so as to place the air valve 160 in the position illustrated in FIG. 6. Also, at the instant of start up as illustrated in FIG. 6, the main drive member 120 is positioned against limit stop member 144, which is in fact an air valve, so that it is depressed into the position as illustrated in FIG. 6 with air flow passing from the main air supply line 162 through air line 164, and through the valve 144 into air supply line 166. With the air valve 160 positioned as shown air will also pass from line 166 through valve 160 and subsequently through adjustable control valve 168 into air reservoir 170. This in turn results in air pressure being applied through air line 172 to valve 174 so that it is shifted into the position as illustrated in FIG. 6.

In this position, air is permitted to flow from the main air supply line 162 through valve 174 and adjustable control valve 176, and through line 178 into the upper portions of double acting pneumatic cylinders 60 and 62 so as to cause the pistons 180 and 182 therein to be moved downwardly. Pistons 180 and 182 are respectively drivingly secured to vertically extending end rods 50 and 52 as previously discussed and illustrated in FIGS. 1 and 2. Thus downward movement of the pistons 180 and 182 as illustrated in FIG. 6, causes downward movement of the vertical end rods 50 and 52 which in turn causes downward movement of the silk screen 20 and squeegee 70 into the printing position.

Simultaneously, with air flow in line 178 air will flow through line 184 and force valve 186 downwardly against the bias of spring 188 to thus cause air flow from the main air supply line 162 through the valve 186 and into air line 190 which acts upon valve 192 to force it against the bias of spring 194 into the position as illustrated in FIG. 6. In this position, and with the master air control valve 196 in the on position, air will be supplied from the main air supply line 162 through line 198 and through valve 192 to the left side of double acting pneumatic cylinder 130 as shown in FIG. 6. This will cause movement of the piston 134 of cylinder 130, to the right as shown so as to cause movement of the main drive member 120 to the left. This will result in printing on the object since the silk screen and squeegee is in position as the drive member 120 moves from right to left as shown in FIG. 6. It is to be noted that as the drive member 120 moves away from valve 144 the bias spring 202 moves valve 144 to an inoperative position where air will not be supplied to valve 160.

When the drive member 120 reaches limit stop 142, which is also an air valve, it will move the air valve from the inoperative position as shown in FIG. 6, to an operative position against the bias of spring 204 so that air will flow from the main supply line 162 through valve 142 and into air line 206. Air line 206 is in turn connected to valve 174 to force it to the right as shown in FIG. 6, so that air from the main supply line 162 will then pass through the adjustable control valve 208, into accumulators 212 and 214 and subsequently into pneumatic cylinders 60 and 62 in order to drive pistons 180 and 182 upwardly.

This in turn causes upward movement of vertically extending end rods 50 and 52 which will then lift the silk screen 20 and squeegee 70 off of the object after completion of printing thereon. Also, since air is no longer supplied to line 178, it will likewise no longer be supplied through line 184 to valve 186 and thus spring 188 will force valve 186 to the inoperative position thus releaving air pressure against valve 192. Therefore, spring 194 will return the movement of the valve 192 to the left so as to connect air line 198 through adjustable control valve 214 to the opposite side of piston 134 and thus move main drive member 120 in the opposite direction, i.e. to the right as shown in FIG. 6.

Thus the drive member 120 and either the squeegee 70 or silk screen 20 will be moved back to the starting position while being lifted off of the object being printed and the cycle will then be restarted upon contact with limit stop 144 so long as the foot pedal 158 is depressed. If, however, the foot pedal 158 has been released, the drive member 120 will come to rest against limit stops 144 after depressing spring 202 so that an air path is established through limit stop 144 up to valve 160. Thus, either automatic or semi-automatic operation of the machine may be effected with the foot pedal.

With regard to the means for holding an object to be printed, if the object is a surface of revolution rather than a flat piece, it would be appropriate to hold the object in a stationary position while rotating it about its axis of symmetry with the surface to be printed in a horizontal plane adjacent the squeegee 70 which is also held stationary, while moving the silk screen 20 back and forth using the pneumatic control mechanism just described above. To effect this operation the mechanism for holding an object such as a cylindrical bottle 300 is illustrated in FIG. 1.

A cylindrical bottle 300 can, for example, be a plastic, semi-flexible container with appropriate indentations on the bottom edge portion 301 thereof opposite the neck portion 302. The identations are conventionally used to engage the bottom surface of the bottle with a driving mechanism in order to rotate the bottle as the silk screen is moved across its surface in order to place the design around the circumference of the bottle 300. The mechanism illustrated in the present invention includes a centering spindle 304 which is driven axially into bottle 300 by air cylinder 305 and is supported by a bracket 306 secured to an extension 308 of the main machine frame.

In addition, in the present device, the spindle 304 is hollow and air is introduced through the spindle to provide compressed air to the bottle 300 in order to maintain the printing service under pressure so that it is more rigid than it would be if the inside of the bottle were open to atmosphere. The bottom portion 301 of the bottle is engaged with a cylindrical driving head 312 having pawls engagable with the indentations in the bottom 301 of bottle 300 and which is rotatably mounted on a shaft 314 supported by a bracket 316 mounted to the main machine frame.

On the remote portion of the drive shaft from the driving head 312 is mounted a gear 318 which engages a rack 320 mounted to the drive member 120 for movement therewith. Thus it can be seen that as the drive member 120 is moved back and forth across the width of the machine, the gear 318 is rotated so that the cylindrical surface of the bottle 300 is rotated in coordination with the movement of the silk screen to place the design on the surface of the bottle 300. The gear 318 may be changed to accommodate different diameters of bottle 300 so that the relative movement between the surface of the bottle and the silk screen is the same. In this regard the drive shaft 314 is adjustably positionable vertically in the bracket 316, as is the spindle 304 and associated air cylinder 310 in bracket 306.

In order to maintain the driving head 312 in engagement with the ratchet-type indentations in the bottom of bottle 300, a belt and pulley arrangement is utilized.

Pulley 322 is mounted on the drive shaft for rotation therewith and pulley 324 is mounted to the drive shaft of a motor 326. A belt 328 is entrained about pulleys 322 and 324, such as, for example, a bungi cord can be used in order to permit the above referred to change in position of the drive shaft 314 for different types of bottles. In addition, the belt 328 is designed to slip on the pulley 322 and since the drive motor rotates pulley 324 at a higher rate of speed than is needed to rotate the drive shaft 314 in order to coordinate the movement of the surface of bottle 300 with that of the silk screen 20, the belt will slip and provide a positive engagement between the driving head 312 and the indentations on the bottom portion 301 of the bottle 300.

It is to be understood that while the screen is generally referred to above as being formed of silk, it is intended that, consistent with the use of the terminology in the art, the term silk shall include other commercially available fabrics such as nylon and the like.

Although the foregoing description illustrates the preferred embodiments of the present invention, other variations are possible. All such variations as would be obvious to one skilled in this art are intended to be included within the scope of the invention as defined by the following claims.

What is claimed is:

1. A screen printing machine, comprising:

a machine frame;

screen carrier support means having at least one horizontally extending support member, and a pair of end rods disposed in spaced parallel relation in a vertical plane supported on said frame and supporting said support member for up and down movement;

a screen carrier laterally movably mounted to said screen carrier support means for vertical movement therewith;

first pneumatic drive means directly engaging both said end rods for causing said up and down movement of said screen carrier support means on command;

a squeegee carrier;

a squeegee carrier support means supported by said screen carrier support means for vertical movement therewith and for laterally movement thereon and connected thereto with a parallelogram linkage means for causing relative movement between said squeegee carrier and said screen carrier upon vertical movement of said screen carrier support means;

second pneumatic drive means comprising a double acting pneumatic cylinder means disposed parallel to said at least one horizontally extending support member and extending the length of maximum reciprocal movement of said squeegee carrier support means and said screen carrier;

a first yoke member secured to a central portion of said squeegee carrier support means;

a second yoke member secured to a central portion of said screen carrier; and, a connector arm pivotally mounted to a bracket driven by a piston portion of said pneumatic cylinder means for reciprocal movement therewith and selectively engagable with said first or second yoke member for causing lateral reciprocal movement of either.

2. A screen printing machine as defined in claim 1 wherein said second pneumatic drive means further includes:

limit stop means laterally adjustably securable at each end portion of said pneumatic cylinder means for reversing the direction of travel of said piston portion when said limit stop means is reached.

3. A screen printing machine as defined in claim 2 wherein said limit stop means further includes:

a pair of two-way pneumatic valves one each positioned at opposite end portions of said pneumatic cylinder means and operatively connected between an air source and said pneumatic cylinder means for reversing the direction of movement thereof, each of said valves having a control member engagable with said bracket driven by said piston portion to thereby reverse the direction of travel of said piston portion upon contact between said bracket and either said control member.

4. A screen printing machine as defined in claim 3 and further including:

said first pneumatic drive means having a pair of pneumatic cylinder means each with a piston portion secured to a respective said end rod for causing said up and down movement thereof;

said pneumatic valves are further operatively connected to said pair of pneumatic cylinder means so as to cause upward vertical movement of said screen carrier support means upon contact between said bracket and a first of said control members and for causing downward vertical movement of said screen carrier support means upon contact between said bracket and a second of said control members.

5. A screen printing machine as defined in claim 4 further including:

means positioned beneath said screen carrier for supporting an object to be printed on, said object support means being rotatably driven to synchronously rotate an object with lateral movement of said screen carrier support means.

6. A screen printing machine as defined in claim 5 wherein said object support means further includes:

a rack and pinion, said rack being secured to said bracket driven by said piston portion of said second drive means for movement therewith and said pinion being secured to a drive shaft means for rotatably supporting an object to be printed on.

* * * * *